US009168543B2

(12) United States Patent
Zhou et al.

(10) Patent No.: US 9,168,543 B2
(45) Date of Patent: Oct. 27, 2015

(54) ROTARY SWITCH SHOWER AND ITS CONTROL METHOD

(75) Inventors: Huasong Zhou, Xiamen (CN); Haisong Peng, Xiamen (CN); Renzhong Li, Xiamen (CN); Bin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 790 days.

(21) Appl. No.: 13/509,741

(22) PCT Filed: Nov. 1, 2010

(86) PCT No.: PCT/CN2010/078273

§ 371 (c)(1), (2), (4) Date: May 14, 2012

(87) PCT Pub. No.: WO2011/063699

PCT Pub. Date: Jun. 3, 2011

(65) Prior Publication Data

US 2013/0254985 A1 Oct. 3, 2013

(30) Foreign Application Priority Data

Nov. 25, 2009 (CN) ..... 2009 1 0252619

(51) Int. Cl.

| | |
|---|---|
| ***A47K 3/00*** | (2006.01) |
| ***B05B 1/18*** | (2006.01) |
| ***B05B 1/16*** | (2006.01) |

(52) U.S. Cl.

CPC ..... *B05B 1/185* (2013.01); *B05B 1/1654* (2013.01); *B05B 1/18* (2013.01)

(58) Field of Classification Search

CPC ..... E03C 1/06; E03C 1/0409; B05B 1/18
USPC ..... 4/615, 616, 567, 568, 570
See application file for complete search history.

(56) References Cited

U.S. PATENT DOCUMENTS

| | | | | |
|---|---|---|---|---|
| 7,237,277 | B1 * | 7/2007 | Tsai | 4/615 |
| 2011/0147490 | A1 * | 6/2011 | Chen | 239/289 |

FOREIGN PATENT DOCUMENTS

| | | | |
|---|---|---|---|
| CN | 2261299 | Y | 9/1997 |
| CN | 201140131 | Y | 10/2008 |
| CN | 101357354 | A | 2/2009 |
| CN | 201287087 | Y | 8/2009 |
| CN | 201534116 | U | 7/2010 |

* cited by examiner

*Primary Examiner* — Huyen Le
(74) *Attorney, Agent, or Firm* — Rabin & Berdo, P.C.

(57) ABSTRACT

A rotary switch shower with a handheld component has a waterway connected to a water outlet eccentrically arranged on a first counterface of the connecting end of the handheld component. The handheld component includes: an outlet component with an essential body, at least two outlet terminals, and a plurality of independent cavities. The outlet terminals are assembled on the essential body and communicate with the independent cavities respectively. Every independent cavity is has a water inlet on the second counterface of the essential body. The water inlets are assigned along an arc whose center is at the rotation axis. The essential body can be rotatably assembled to the handheld component, and switching of the waterways is achieved by rotating the handheld component, so that a water inlet is chosen to communicate with the water outlet, and then a independent cavity is chosen to communicate with the waterway.

18 Claims, 8 Drawing Sheets

ROTARY SWITCH SHOWER AND ITS CONTROL METHOD

FIELD OF THE INVENTION

The present invention relates to a shower, more particular to a rotary switch shower.

BACKGROUND OF THE INVENTION

The shower has been widely used in the daily life. The utility model ("multifunctional bilateral nozzle massage", application number CN96249528.0) discloses a bilateral nozzle massage, which comprises a handle, a nozzle shell with two outlet face, a two-way control interlock switch which is arranged in the nozzle shell and controls the switch of the nozzle's different water feature. However, a two-way control interlock switch is needed to be arranged on its shell, it makes the manufacturing processes complex, and the user can not switch different water features directly; and additional parts are needed to be arranged in its outlet terminals to achieved different outlet effects, for example, the roll balls is arranged in one lateral face, and the spongiform flexible body and a plurality of water outlet holes are arranged in another lateral face, it makes the manufacturing processes complex and the product design can not be light and thin.

SUMMARY OF THE INVENTION

The object of the present invention is to offer a rotary switch shower, which solves the technical matters at the prior art.

One of the technical proposals to solve the technical matters in the present invention is:

A rotary switch shower, it comprises:

A handheld component, which is provided with a waterway, and the waterway is provided with a water outlet that is eccentrically arranged on the first counterface of the connecting end of the handheld component; and A outlet component, which comprises a essential body and at least two outlet terminals, and the essential body is provided with a plurality of independent cavities whose amount is equal to the outlet terminals' amount, and the outlet terminals are assembled on the essential body and communicate with the independent cavities respectively, and every independent cavity is provided with a water inlet that is arranged on the second counterface of the essential body, these said water inlets are assigned along the arc whose centre is at the rotation axis;

The essential body can be rotatably assembled to the handheld component, the first counterface and the second counterface are hermetically Marching to each other, and switching of the waterways is achieved by rotating the handheld component, so that a water inlet is chosen to communicate with the water outlet, and then a independent cavity is chosen to communicate with the waterway.

In a preferred embodiment, the radius of the arc where these said water inlets are assigned is adaptive to the distance between the water outlets and the rotation axis.

In a preferred embodiment, a diameter-enlarged hole is arranged in the water outlet of the waterway of the handheld component, a leather cup is arranged in the diameter-enlarged hole in a sliding manner, and an elastic piece is arranged between the ring end of the diameter-enlarged hole and the leather cup.

In a preferred embodiment, the essential body is cuboid-like, a circular groove is concavely arranged on the near end face of the essential body, and the bottom surface of the circular groove is the second counterface, the circular groove can be rotatably sleeved to the connecting end of the handheld component.

In a preferred embodiment, an assembling slot that is perpendicular to the axis of the circular groove and penetrates the circular groove is opened up in the essential body; the connecting end of the handheld component is arranged to be a rotary body, and a ring channel is concavely arranged in the middle of the rotary body; a jaw that is clamped with the ring channel through the assembling slot is also provided, so that a constraint is formed between the handheld component and the outlet component.

In a preferred embodiment, the jaw comprises a cross rod and two claw feet that are fixed at the two sides of the cross rod, and a inner belly with a opening is formed by the two claw feet, the inner belly is adaptive to the diameter of the ring channel, and the spacing of the opening is smaller than the diameter of the ring channel.

In a preferred embodiment, two fillister are concavely arranged on the top surface and the bottom surface of the essential body respectively, the two fillisters correspond to the water outlets and are provided with communicating holes, the independent cavities are formed by the coupling of the fillisters and the communicating holes; two outlet terminals which cover the two fillisters of the essential body respectively are provided.

In a preferred embodiment, two limit slots are concavely arranged on the two sides of the external rotary surface of the connecting end of the handheld component respectively, a through channel that penetrates the circular groove from inside to outside is opened up at one side of the essential body, and a location pin, a resisting spring that resists the location pin, and a regulating screw screwed in the through channel for the resisting spring are assembled in the through channel, the location pin of the through channel is alternatively inserted into the two limit slots.

In a preferred embodiment, the rotation axis of the essential body is perpendicular to the first counterface of the connecting end of the handheld component.

Another technical proposal to solve the technical matters in the present invention is:

A control method of the rotary switch shower:

Open the inlet valve to lead the water into the shower;

The handheld component is rotated, and the water outlet of the handheld is communicated with one of the water inlets of the essential body, and one of the independent cavities is communicated with the waterway, so that water comes out of the outlet terminal corresponding to the independent cavity;

The handheld component is rotated, and the water outlet is communicated with another water inlet, and another independent cavity is communicated with the waterway, so that water comes out of the outlet terminal corresponding to the another independent cavity;

Rotating the handheld component repeatedly switches water coming out of different outlet terminals, so that different water features can be switched.

In a preferred embodiment, the handheld component is rotated to the position for waterway needed, and the handheld component is located through a location pin.

Compared with the shower at the prior art, the benefits of the shower in the present invention are:

1 It is convenient to use, different water features can be easily switched by rotating the water outlet body, and the user can only use one hand to smoothly accomplish the switch; 2 due to the structure design, a additional control unit is unnecessary, and this design saves the components and the manufacturing processes; 3 the product is designed with lightness and thinness, and the appearance is more aesthetic; 4 location-clamping and anti-dropping design ensures the connection between the outlet component and the handheld component more compact and more steady; 5 according to the needs, the outlet terminals can be arranged in each face of the outlet body of the rotary switch shower, and it adds other water features by taking advantages of different outlet area of each face with good practicability; 6 the coupling of the elastic piece and the leather cup causes the sealing between components tight and avoids the water leakage and crossing well; the rotation axis of the essential body is perpendicular to the first counterface of the connecting end of the handheld component, so that the water will not splash to the users during the switching process.

BRIEF DESCRIPTION OF THE DRAWINGS

With the following description of the drawings and specific embodiments, the invention shall be further described in details.

REFERENCE SIGNS

Handheld component-100; waterway-110; water outlet-111;

diameter-enlarged hole-112; rotary body-120; the first counterface-121; ring channel-122; the first and the second limit slot-123; leather cup-130; elastic piece-140;

Outlet component-200; essential body-210; circular groove-211; assembling slot-212; the first and the second fillister-213, 214; the first and the second communicating hole-2131, 2141; through channel-215; location pin-2151, resisting spring-2152, regulating screw-2153; the first and the second outlet terminal-220, 230; the second counterface-240; the first and the second water inlet-241, 242;

Jaw-300; cross rod-310; claw foot-320.

DESCRIPTION OF THE PREFERRED EMBODIMENTS

With reference of FIG. 1, FIG. 2, FIG. 3, FIG. 4 and FIG. 5, it is the abridged general view of the rotary switch shower in the present invention according to the preferred embodiment.

Figure 1:
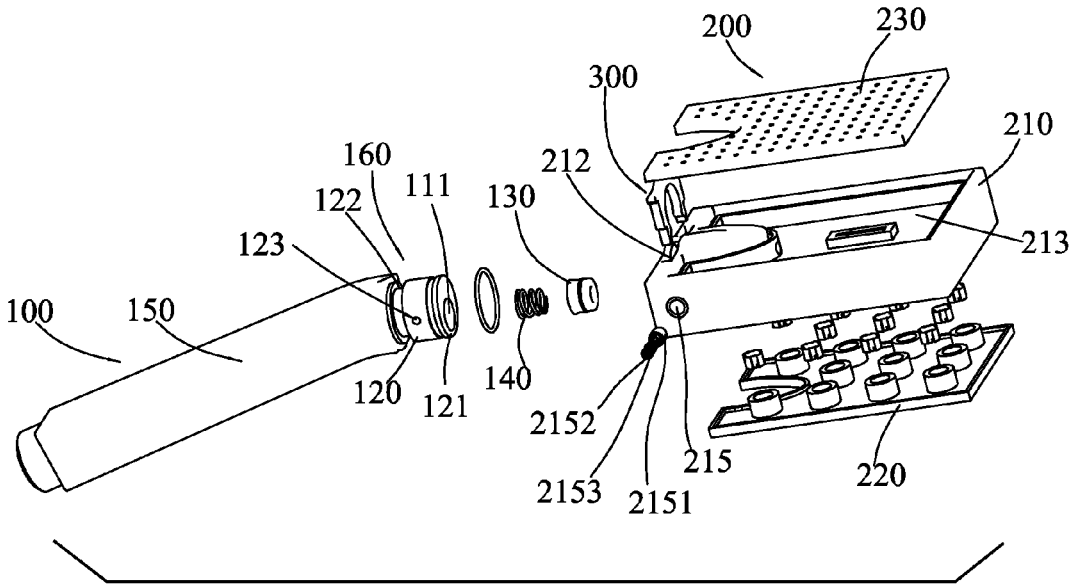
FIG. 1 shows the exploded view of the rotary switch shower in the present invention according to the preferred embodiment.

As shown in FIG. 1, the present rotary switch shower comprises a handheld component 100, an outlet component 200, and a jaw 300.

The handheld component 100 is provided with a handheld part 150 and a connecting end 160 which is formed by the bending and extending outward of the handheld part, the handheld component 100 that is fold linear fits the traditional usage and is easier to be accepted by the clients. The handheld component 100 comprises a hollow perforating waterway 100, the waterway 110 is provided with a water outlet 111, the water outlet 111 is eccentrically arranged on the first counterface 121 of the connecting end of the handheld component, the water outlet 111 is provided with a diameter-enlarged hole 112, a leather cup 130 is arranged in the diameter-enlarged hole 112 in a sliding manner, and an elastic piece 140 resists the leather cup and is located in the diameter-enlarged hole 112 and on the ring end of the leather cup, so that the sealing function is achieved. In this embodiment, the elastic piece is spring. The connecting end of the handheld component is arranged to be a rotary body 120, a ring channel 122 is opened up in the middle of the rotary body 120, and two limit slots 123 and 124 are arranged in the two sides of the rotary body 120 respectively.

Figure 3:
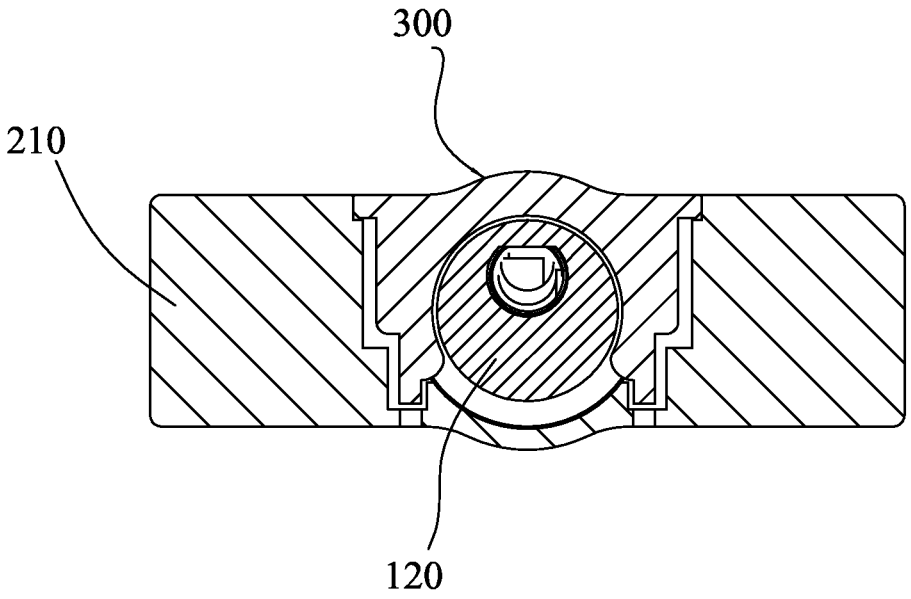
FIG. 3 shows the second sectional view of the rotary switch shower in the present invention according to the preferred embodiment when the handheld component is fixed to the outlet component.
Figure 4:
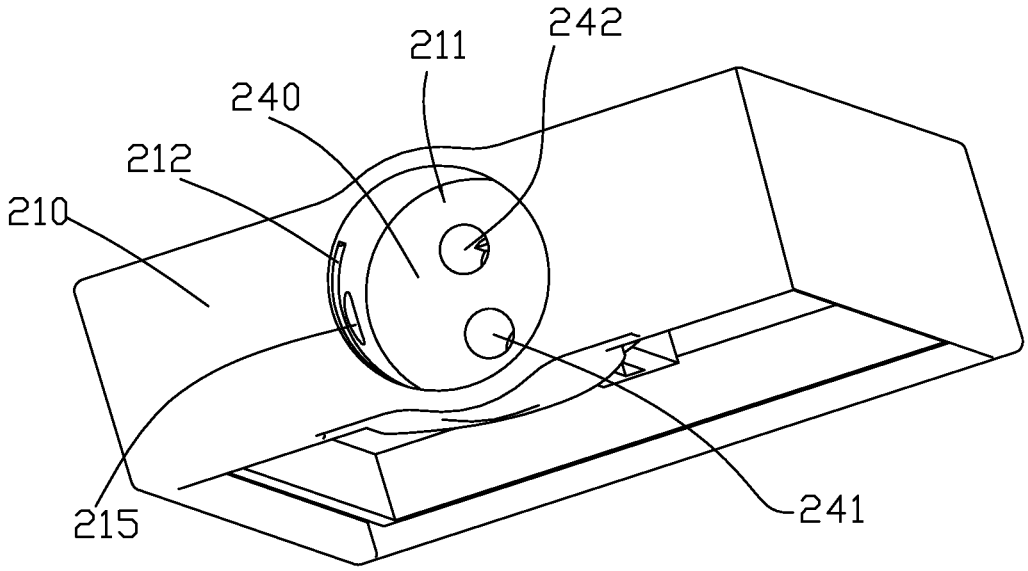
FIG. 4 shows the solid abridged general view of the outlet component of the rotary switch shower in the present invention according to the preferred embodiment.
Figure 5:
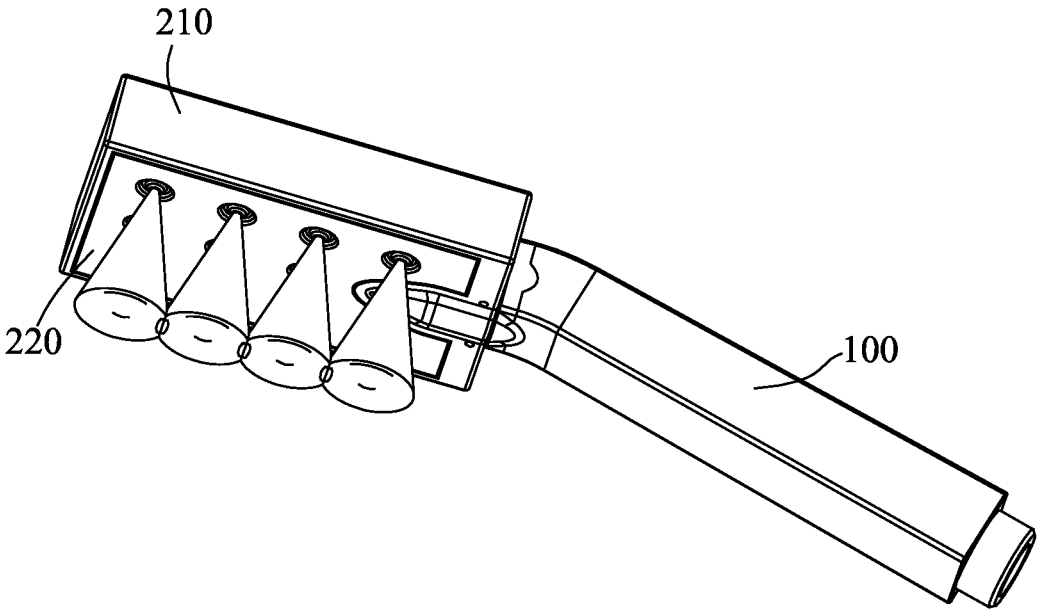
FIG. 5 shows the first solid abridged general view of the rotary switch shower in the present invention according to the preferred embodiment when the spraying water comes out of the shower.

The outlet component 200 comprises a cuboid-like essential body 210, a first terminal 220 and a second outlet terminal 230. The essential body 210 comprises a circular groove 211, an assembling slot 212, a first fillister 213, a second fillister 214, and a through channel 215. The sleeving place of the essential body 210 and the connecting end of the handheld component 100 is a circular groove 211, the bottom surface of the circular groove 211 is the second counterface 240, the first and second counterfaces are hermetically inarching to each other, the rotation axis of the essential body is perpendicular to the first counterface 121 of the connecting end of the handheld component; the second counterface 240 is provided with a first water inlet 241 and a second water inlet 242 that are communicating respectively with the waterway 110 alternatively; the assembling slot 212 is perpendicular to the axis of the circular groove 211 and penetrates the circular groove; and the essential body is provided with two independent fillister, namely a first fillister 213 and a second fillister 214, which are provided respectively with a first communicating hole 2131 and a second communicating hole 2141 that communicate with the first water inlet 241 and the second water inlet 242 alternatively, the first water inlet 241 and second water inlet 242 are assigned around the axis of the handheld component in accordance with the centre of circle. As shown in FIG. 3, the radius of the arc where these said water inlets are assigned is adaptive to the distance between the water outlet 111 and the rotation axis;

The through channel 215 is arranged at the connecting end of the essential body 220 and the handheld component, and it runs through to the annular wall of the circular groove 211, as shown in FIG. 1 and FIG. 3, a location pin 2151, a resisting spring 2152 that resists the location pin, and a regulating screw 2153 screwed in the through channel 215 for the resisting spring 2152 are assembled in the through channel 215, the location pin is alternatively inserted into the first limit slot 123 or the second first limit slot 124 of the rotary body 120;

The first fillister 213 and the second fillister 214 are respectively opened up on the top surface and the bottom surface of the essential body 210, and they form a first independent cavity and a second independent cavity with the first communicating hole 2131 and the second communicating hole 2141 respectively, the two independent cavities are corresponding to the first terminal 220 and the second terminal 230 respectively, the first outlet terminal and the second outlet terminal cover the first fillister 213 and the second fillister 214 respectively.

Figure 2:
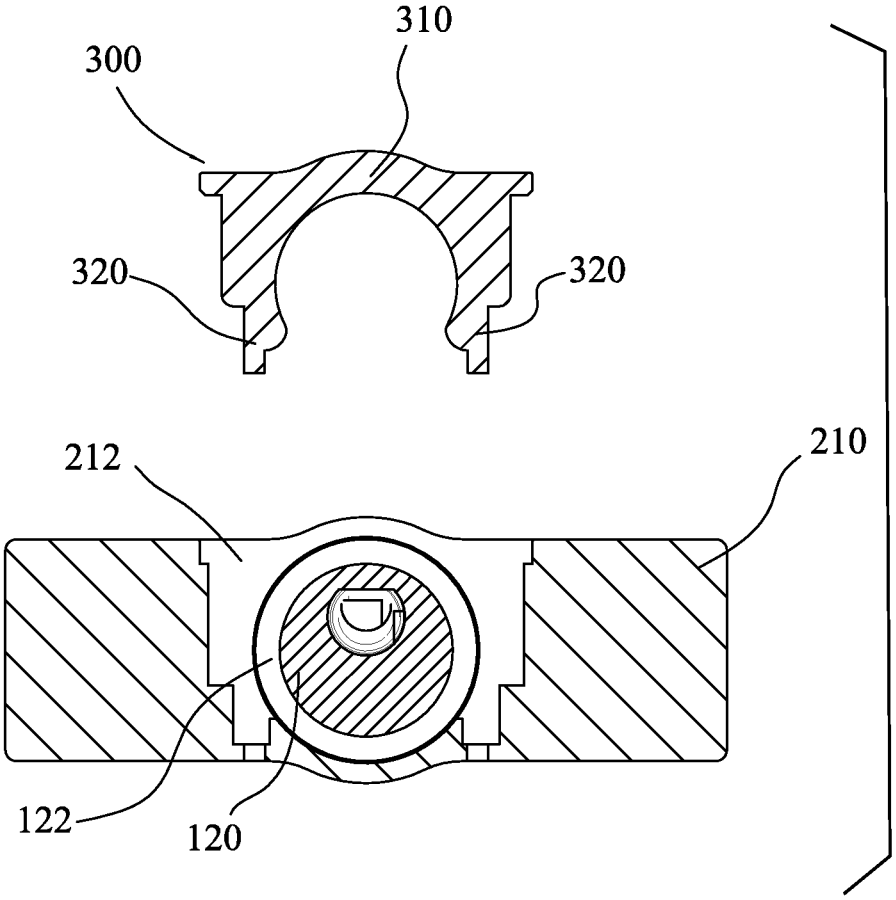
FIG. 2 shows the first sectional view of the rotary switch shower in the present invention according to the preferred embodiment when the handheld component is fixed to the outlet component.

As shown in FIG. 2 and FIG. 3, the jaw 300 comprises a cross rod 310 and a pair of claw feet 320 that are contrapuntally arranged at the two sides of the cross rod 310, and they form a inner belly with a downward opening, the inner belly is adaptive to the diameter of the ring channel 122, and the size of opening of the inner belly is smaller than the diameter of the ring channel 122, the jaw 300 is clamped with the ring channel 122 through the assembling slot 212, so that the detachment of the handheld component 100 and the essential body 210 is prevented.

The control method of the rotary switch shower is:

Step 1. the inlet valve is open, the water enters the shower at the moment.

Figure 6:
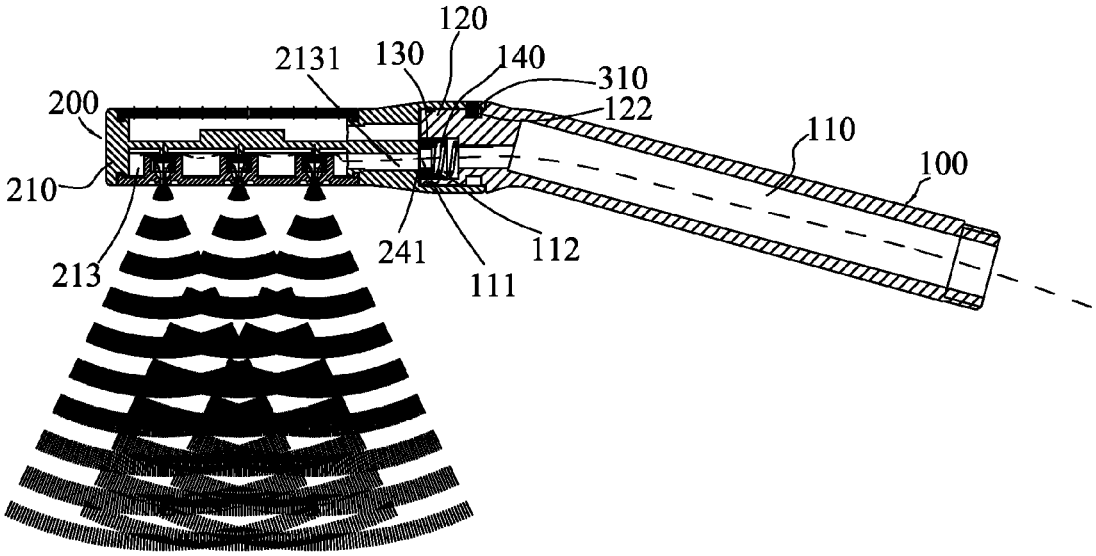
FIG. 6 shows the first sectional view of the rotary switch shower in the present invention according to the preferred embodiment when the spraying water comes out of the shower.
Figure 7:
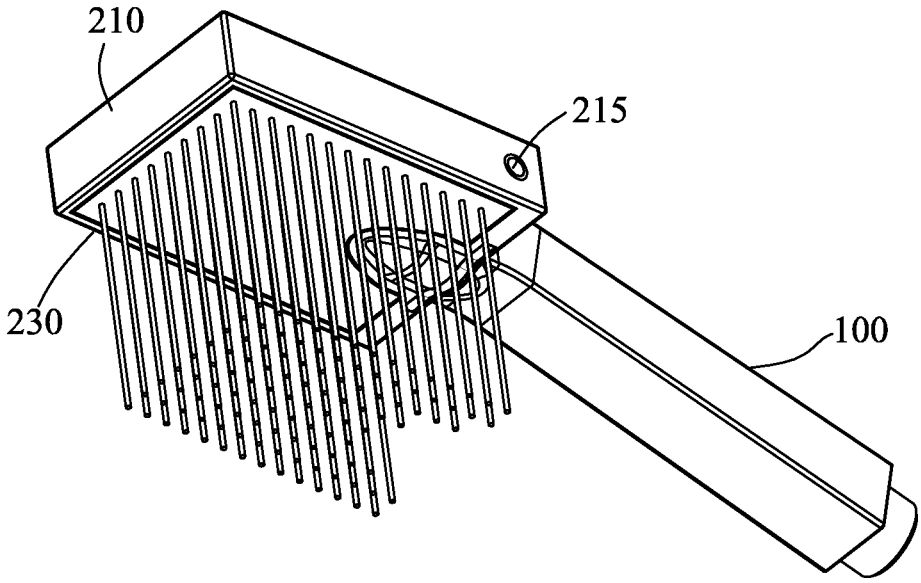
FIG. 7 shows the second solid abridged general view of the rotary switch shower in the present invention according to the preferred embodiment when the shower water comes out of the shower.
Figure 8:
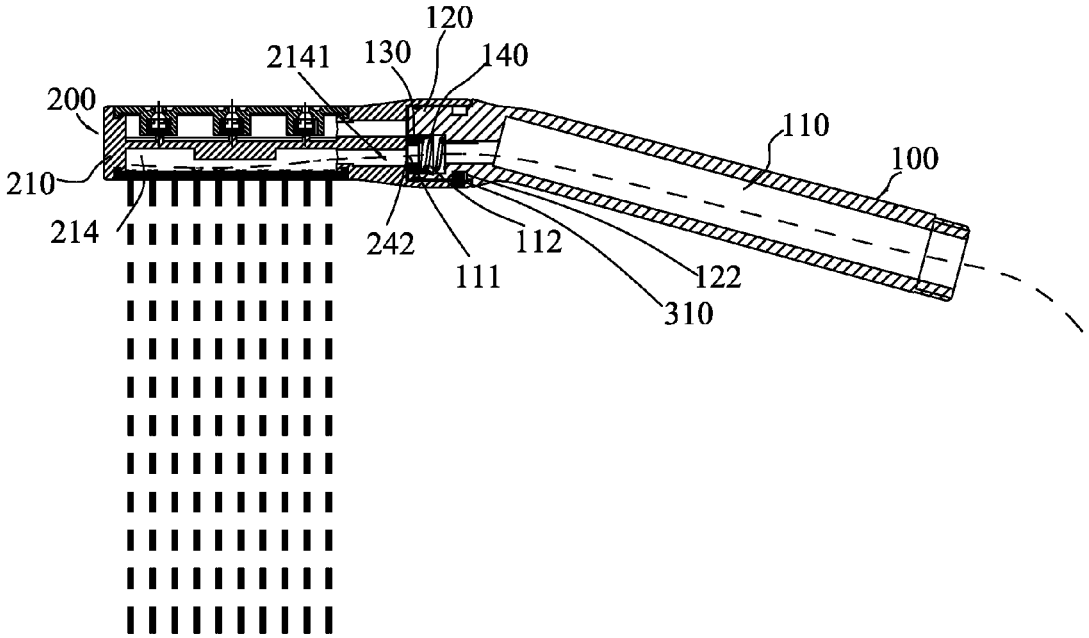
FIG. 8 shows the second sectional view of the rotary switch shower in the present invention according to the preferred embodiment when the shower water comes out of the shower.

Step 2. Combining with FIG. 5 and FIG. 6, the handheld component 100 is rotated, and the handheld component 100 stops rotating and is fixed to the essential body 210 under the coupling of the location pin 2151, the resisting spring 2152 and the regulating screw 2153, the water outlet 111 is communicated with one of the water inlets, assuming that is the first water inlet 241, the first independent cavity is communicated with the waterway 110, so that water comes out of the outlet terminal 220 to which the independent cavity is corresponded, and the spraying water comes out of the shower;

Step 3. Combining with FIG. 7 and FIG. 8, the handheld component 100 is rotated when the switch of the water features is needed, the location pin 2152 is left from the first limit slot and is inserted into the second limit slot to limit the handheld component, the water outlet 111 is communicated with the second water inlet 242, and the second independent cavity is communicated with the waterway 110 at the moment, so that water comes out of the outlet terminal 230 to which the independent cavity is corresponded, and the shower water comes out of the shower;

Step 4. Rotating the handheld component 100 repeatedly switches water coming out of different outlet terminals, so that different water features can be switched.

As mentioned above, it is only the preferred embodiments in the present invention, therefore it cannot limit the reference implementation of the invention. It is obvious to a person skilled in the art that structural modification and changes can be carried out without leaving the scope of the claims hereinafter and the description above.

Industrial Applicability

The rotary switch shower in the present invention can switch the waterways by rotating the handheld component, so that a water inlet can be chosen to communicate with the water outlet, and a independent cavity can communicate with the waterway, as a result, different waterways can be chosen. The shower is provided with a compact structure that can save the manufacturing process and can fit the trend of lightness and thinness.

What is claimed is:

1. A rotary switch shower, wherein it comprises:

a handheld component, which is provided with a waterway, and the waterway is provided with a water outlet that is eccentrically arranged on a first counterface of a connecting end of the handheld component; and an outlet component, which comprises a essential body and at least two outlet terminals, and the essential body is provided with a plurality of independent cavities whose amount is equal to the outlet terminals' amount, and the outlet terminals are assembled on the essential body and communicate with the independent cavities respectively, and every independent cavity is provided with a water inlet that is arranged on a second counterface of the essential body, these said water inlets are assigned along the arc whose centre is at the rotation axis;

the essential body can be rotatably assembled to the handheld component, the first counterface and the second counterface are hermetically grafted to each other, and switching of the waterways is achieved by rotating the handheld component, so that a water inlet is chosen to communicate with the water outlet, and then an independent cavity is chosen to communicate with the waterway, wherein a diameter-enlarged hole is arranged in the water outlet of the waterway of the handheld component, a leather cup is arranged in the diameter-enlarged hole in a sliding manner, and an elastic piece is arranged between the ring end of the diameter-enlarged hole and the leather cup.

2. A rotary switch shower according to claim 1, wherein the radius of the arc where these said water inlets are assigned is adaptive to a distance between the water outlets and the rotation axis.

3. A rotary switch shower according to claim 2, wherein said essential body is cuboid shaped, a circular groove is concavely arranged on the near end face of the essential body, and the bottom surface of the circular groove is the second counterface, the circular groove can be rotatably sleeved to the connecting end of the handheld component.

4. A rotary switch shower according to claim 3, wherein an assembling slot that is perpendicular to the axis of the circular groove and penetrates the circular groove is opened up in the essential body;

the connecting end of the handheld component is arranged to be a rotary body, and a ring channel is concavely arranged in the middle of the rotary body;

a jaw that is clamped with the ring channel through the assembling slot is also provided, so that a constraint is formed between the handheld component and the outlet component.

5. A rotary switch shower according to claim 4, wherein said jaw comprises a cross rod and two claw feet that are fixed at the two sides of the cross rod, and an inner belly with an opening is formed by the two claw feet, the inner belly is adaptive to the diameter of the ring channel, and the spacing of the opening is smaller than the diameter of the ring channel.

6. A rotary switch shower according to claim 5, wherein two fillister are concavely arranged on the top surface and the bottom surface of the essential body respectively, the two fillisters correspond to the water outlets and are provided with communicating holes, the independent cavities are formed by the coupling of the fillisters and the communicating holes;

two outlet terminals which cover the two fillisters of the essential body respectively are provided.

7. A rotary switch shower according to claim 6, wherein
two limit slots are concavely arranged on the two sides of the external rotary surface of the connecting end of the handheld component respectively,
a through channel that penetrates the circular groove from inside to outside is opened up at one side of the essential body, and
a location pin, a resisting spring that resists the location pin, and a regulating screw screwed in the through channel for the resisting spring are assembled in the through channel, the location pin of the through channel is alternatively inserted into the two limit slots.

8. A rotary switch shower according to claim 5, wherein, the rotation axis of the essential body is perpendicular to the first counterface of the connecting end of the handheld component.

9. A rotary switch shower according to claim 4, wherein
two fillister are concavely arranged on the top surface and the bottom surface of the essential body respectively,
the two fillisters correspond to the water outlets and are provided with communicating holes,
the independent cavities are formed by the coupling of the fillisters and the communicating holes;
two outlet terminals which cover the two fillisters of the essential body respectively are provided.

10. A rotary switch shower according to claim 9, wherein
two limit slots are concavely arranged on the two sides of the external rotary surface of the connecting end of the handheld component respectively,
a through channel that penetrates the circular groove from inside to outside is opened up at one side of the essential body, and
a location pin, a resisting spring that resists the location pin, and a regulating screw screwed in the through channel for the resisting spring are assembled in the through channel, the location pin of the through channel is alternatively inserted into the two limit slots.

11. A rotary switch shower according to claim 4, wherein, the rotation axis of the essential body is perpendicular to the first counterface of the connecting end of the handheld component.

12. A rotary switch shower according to claim 3, wherein
two fillister are concavely arranged on the top surface and the bottom surface of the essential body respectively,
the two fillisters correspond to the water outlets and are provided with communicating holes,
the independent cavities are formed by the coupling of the fillisters and the communicating holes;
two outlet terminals which cover the two fillisters of the essential body respectively are provided.

13. A rotary switch shower according to claim 12, wherein
two limit slots are concavely arranged on the two sides of the external rotary surface of the connecting end of the handheld component respectively,
a through channel that penetrates the circular groove from inside to outside is opened up at one side of the essential body, and
a location pin, a resisting spring that resists the location pin, and a regulating screw screwed in the through channel for the resisting spring are assembled in the through channel, the location pin of the through channel is alternatively inserted into the two limit slots.

14. A rotary switch shower according to claim 3, wherein, the rotation axis of the essential body is perpendicular to the first counterface of the connecting end of the handheld component.

15. A rotary switch shower according to claim 2, wherein, the rotation axis of the essential body is perpendicular to the first counterface of the connecting end of the handheld component.

16. A rotary switch shower according to claim 1, wherein, the rotation axis of the essential body is perpendicular to the first counterface of the connecting end of the handheld component.

17. A control method of a rotary switch shower, comprising:
opening an inlet valve to lead the water into the shower;
rotating a handheld component wherein a water outlet of the handheld component communicates with one of a plurality of water inlets of the essential body, and one of a plurality of independent cavities communicates with a waterway, so that water comes out of an outlet terminal corresponding to the one of the plurality of independent cavities;
rotating the handheld component, wherein the water outlet communicates with another water inlet, and another independent cavity communicates with the waterway, so that water comes out of the outlet terminal corresponding to the another independent cavity;
rotating the handheld component repeatedly switches water coming out of different outlet terminals, so that different water features can be switched, wherein
a diameter-enlarged hole is arranged in the water outlet of the waterway of the handheld component,
a leather cup is arranged in the diameter-enlarged hole in a sliding manner, and
an elastic piece is arranged between the ring end of the diameter-enlarged hole and the leather cup.

18. A control method of the rotary switch shower according to claim 17, wherein the handheld component is rotated to the position for waterway needed, and the handheld component is located through a location pin.

* * * * *